US008845279B2

(12) United States Patent
Hoecker et al.

(10) Patent No.: US 8,845,279 B2
(45) Date of Patent: Sep. 30, 2014

(54) SUPERCHARGER DEVICE

(75) Inventors: Patric Hoecker, Landau (DE); Florian Rentz, Stuttgart (DE); Ian Reynolds, Kettering (GB)

(73) Assignee: Bosch Mahle Turbo Systems GmbH & Co. KG (DE)

( * ) Notice: Subject to any disclaimer, the term of this patent is extended or adjusted under 35 U.S.C. 154(b) by 1167 days.

(21) Appl. No.: 12/744,143

(22) PCT Filed: Nov. 13, 2008

(86) PCT No.: PCT/EP2008/065453

§ 371 (c)(1),
(2), (4) Date: Aug. 23, 2010

(87) PCT Pub. No.: WO2009/065763

PCT Pub. Date: May 28, 2009

(65) Prior Publication Data

US 2010/0316489 A1 Dec. 16, 2010

(30) Foreign Application Priority Data

Nov. 21, 2007 (DE) ..... 10 2007 056 154

(51) Int. Cl.
*F04D 29/46* (2006.01)
*F01D 17/16* (2006.01)
*F02B 37/24* (2006.01)

(52) U.S. Cl.
CPC ..... *F01D 17/165* (2013.01); *F05D 2220/40* (2013.01); *F05D 2230/64* (2013.01); *F02B 37/24* (2013.01); *F05D 2230/50* (2013.01)
USPC ..... 415/164

(58) Field of Classification Search
USPC ..... 415/159, 162, 163, 164
See application file for complete search history.

(56) References Cited

U.S. PATENT DOCUMENTS

| | | | | |
|---|---|---|---|---|
| 6,145,313 | A | 11/2000 | Arnold | |
| 6,679,057 | B2 | 1/2004 | Arnold | |
| 7,396,204 | B2 | 7/2008 | Shiraishi et al. | |
| 2005/0252210 | A1 * | 11/2005 | Shiraishi et al. | 60/602 |

FOREIGN PATENT DOCUMENTS

| | | | |
|---|---|---|---|
| DE | 10213897 | A1 | 10/2003 |
| DE | 10337491 | A1 | 3/2005 |

(Continued)

OTHER PUBLICATIONS

Abstract provided for DE102006045514.
Abstract provided for DE102006007347.
Abstract provided for DE102005019938.
Abstract provided for DE102008020932.

(Continued)

*Primary Examiner* — Edward Look
*Assistant Examiner* — Adam W Brown
(74) *Attorney, Agent, or Firm* — Rader, Fishman & Grauer PLLC

(57) ABSTRACT

A supercharger device, including, at least one of a variable turbine and a compressor geometry; a guide vane device arranged in a housing, wherein the guide vane device includes at least one vane mounting ring; at least one guide vane is at least one of rotatably mounted thereon the vane mounting ring and rotatably mounted therein the vane mounting ring; and an adjusting ring arranged coaxially to the vane mounting ring and mounted on the latter, which is rotated relative to the vane mounting ring.

18 Claims, 5 Drawing Sheets

(56) References Cited

FOREIGN PATENT DOCUMENTS

| | | | |
|---|---|---|---|
| DE | 10337495 | A1 | 3/2005 |
| DE | 10262006 | B4 | 9/2005 |
| DE | 102004023209 | A1 | 12/2005 |
| DE | 102004023279 | A1 | 12/2005 |
| DE | 102004037082 | A1 | 3/2006 |
| DE | 102005019938 | A1 | 11/2006 |
| DE | 102006048514 | B3 | 5/2007 |
| DE | 102006007347 | A1 | 8/2007 |
| DE | 102008020932 | A1 | 10/2009 |
| EP | 1009918 | B1 | 11/2004 |
| EP | 1662094 | A2 | 5/2006 |
| WO | WO-2009115451 | A1 | 9/2009 |

OTHER PUBLICATIONS

Abstract provided for DE10213897.
Abstract provided for DE10262006.
Abstract provided for DE10337491.
Abstract provided for EP1662094.
International Search Report dated Nov. 13, 2009.
German Search Report for DE102007056154.9.
English abstract for DE-10337495.
English abstract for DE-102004023209.
English abstract for DE-102004023279.
English abstract for DE-102004037082.

* cited by examiner

SUPERCHARGER DEVICE

CROSS-REFERENCES TO RELATED APPLICATIONS

This application is a National Stage application which claims the benefit of International Application No. PCT/EP2008/065453 filed Nov. 13, 2008, which claims priority based on German Application No. 10 2007 056 154.9, filed Nov. 21, 2007, both of which are hereby incorporated by reference in their entirety.

TECHNICAL FIELD

The invention relates to a supercharger device, particularly an exhaust gas turbocharger for a motor vehicle. The invention additionally relates to a combustion engine for a motor vehicle equipped with such a supercharger device.

BACKGROUND

Exhaust gas turbochargers are usually employed to increase the performance of piston engines, wherein they increase an air and fuel throughput per work cycle. The exhaust gas turbocharger driven by the exhaust gas flow of the piston engine compresses the air fed to the combustion chamber, wherein, because of different engine operating states, it can be advantageous to decouple the compressed air flow fed to the combustion chamber from the exhaust gas flow, so that more preferably efficiency, response characteristics or operating range of the exhaust gas turbocharger can be improved. Such intervention for controlling the exhaust gas turbocharger can for example be achieved through a variable geometry of the nozzle ducts leading to the turbine wheel.

From DE 102 62 006 B4 an exhaust gas turbocharger with a variable turbine geometry is known, which is realised via a vane mounting ring with guide vanes rotatably mounted thereon/therein, wherein the guide vanes can be adjusted via an adjusting ring mounted coaxially to the vane mounting ring and rotatably with respect to the latter. Here, at least three roller bearings are rotatably mounted on the vane mounting ring, which in turn support the adjusting ring via a respective circumferential groove. Here, the roller bearings supporting the adjusting ring can be exclusively mounted in the vane mounting ring or additionally in a housing part, which improves the mounting but significantly aggravates the installation, that is the assembly.

A further charging device with a variable turbine geometry is known for example from EP 1 009 918 B1.

SUMMARY

The present invention deals with the problem of stating an improved embodiment for a generic supercharger device which is more preferably characterized by improved mounting of an adjusting ring.

According to the invention, this problem is solved through the subjects of the independent claims. Advantageous embodiments are the subject of the dependent claims.

The invention is based on the general idea of mounting an adjusting ring coupled with the guide vanes of a guide vane device via slide or roller bearings, wherein these slide or roller bearings are provided on a respective locating pin which penetrates a vane mounting ring carrying the guide vanes and defines its spacing from a housing or from an insert piece/cover disc element arranged therein. Here, the adjusting ring is arranged coaxially to the vane mounting ring and mounted on the latter via the mentioned roller or slide bearings. The adjustment of the guide vanes mounted on the vane mounting ring is brought about via a rotation of the adjusting ring relative to the vane mounting ring. Through the mounting of the adjusting ring on the vane mounting ring via slide or roller bearings, each of which is arranged on a locating pin penetrating the vane mounting ring, the mounting of the adjusting ring can be simplified and the part variety of the supercharger device according to the invention reduced, since the roller or the slide bearings now no longer need to be mounted on the vane mounting ring separately from the locating pins, but can be fixed on the vane mounting ring via the locating pins. Thus the locating pins fulfil two objectives simultaneously, namely defining an axial spacing between the vane mounting ring and a housing or an insert piece/cover disc element arranged in the latter and also acting as carrier for the slide or roller bearings. Because of this, the supercharger device can more preferably also be designed simpler, which contributes to keeping maintenance or repair expenditure low while lowering the manufacturing costs for the supercharger device according to the invention at the same time. In addition, the roller or slide bearings carried by the locating pins ensure particularly smooth-running mounting of the adjusting ring and thus particularly high mounting quality. The high mounting quality here is also responsible for high adjusting accuracy of the guide vane, as a result of which the supercharger device according to the invention can be adapted to the respective operating situation with particular accuracy.

With an advantageous further development of the solution according to the invention a roller bearing with a rotatably mounted bearing roller is provided on each locating pin. A bearing roller rotatably mounted in such a manner can also be produced simply and thus cost-effectively and additionally guarantees particularly smooth-running mounting of the adjusting ring. Here, the adjusting ring can be guided via a ring groove worked into the respective bearing roller in which the adjusting ring engages. With a further advantageous embodiment of the solution according to the invention at least one locating pin comprises a collar at its end carrying the roller bearing, which collar forms an axial stop for the bearing roller. A collar moulded on to the locating pin in such a manner can be produced simply and preferentially in a single common operation together with the locating pin, wherein the locating pin with its longitudinal end facing away from the collar has to be inserted through the vane mounting ring. Obviously, other axial stops for the bearing roller are also conceivable, more preferably clamping pins or lock nuts for example.

Practically at least one locating pin comprises a first radial step via which said locating pin supports itself on the vane mounting ring, wherein an axial spacing between the first radial step and the collar of the locating pin is greater than an axial extension of the roller bearing or the bearing roller so that the latter is arranged with play between the vane mounting ring and the collar of the locating pin. Via the according to the invention first radial stage an axial spacing or accurate position of the locating pin to the vane mounting ring can be predetermined, wherein, when the first radial step contacts the vane mounting ring, the axial spacing between the vane mounting ring and the collar of the locating pin remaining for the bearing roller is greater than the axial longitudinal extension of the bearing roller, so that the latter can always be mounted on the vane mounting ring via the locating pin in a smooth-running manner without jamming. A further measure for ensuring the mounting of the bearing roller without jamming is therefore not required, wherein the first radial step can be produced simply in terms of production and consequently does not burden the supercharger device with additional spacer elements which have to be produced separately for example.

Further important features and advantages of the invention are obtained from the subclaims, from the drawings and from the corresponding figure description by means of the drawings.

It is to be understood that the features mentioned above and still to be explained in the following can not only be used in the respective combination stated, but also in other combinations or by themselves, without leaving the scope of the present invention.

BRIEF DESCRIPTION OF THE DRAWING

Preferred exemplary embodiments of the invention are shown in the drawings and are explained in more detail in the following description, wherein same reference characters refer to same or similar or functionally same components.

Here it shows in each case schematically.

Figure 1:
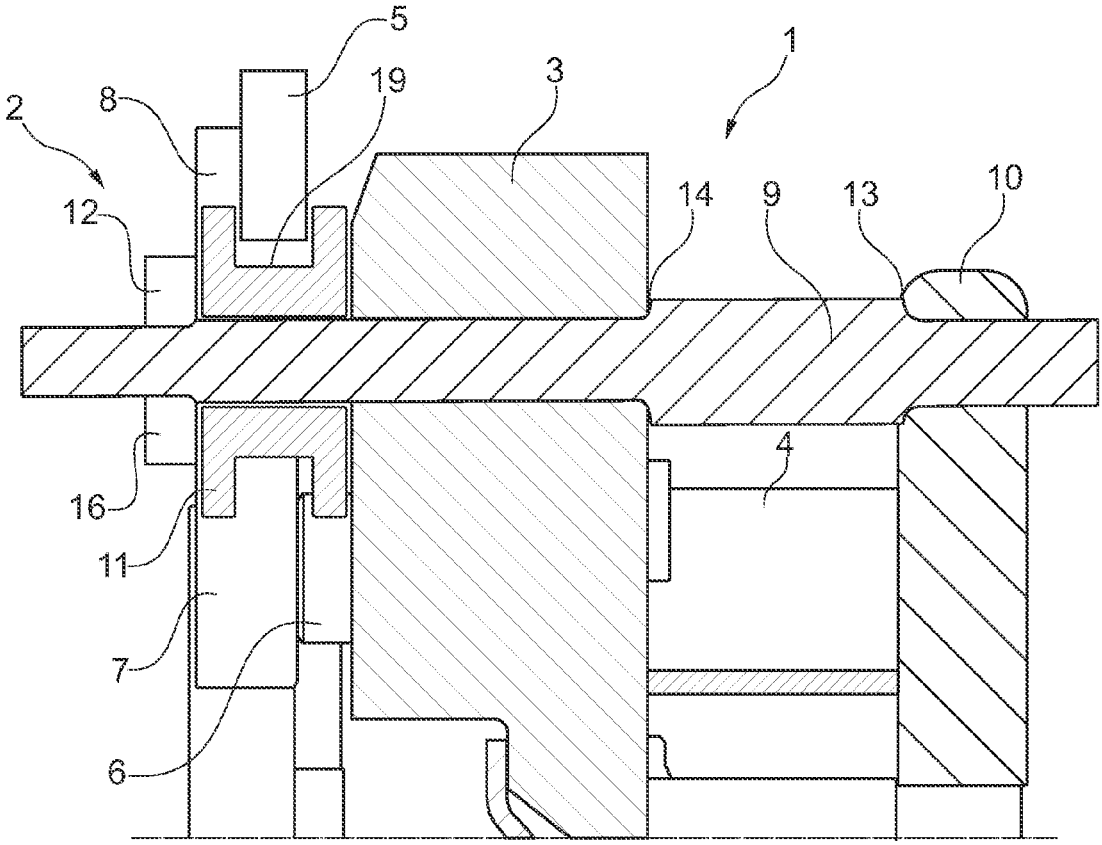
FIGS. 1 to 9 a supercharger device in each case with a roller or slide bearing arranged on a locating pin according to the invention for the mounting of an adjusting ring on the vane mounting ring.

According to FIG. 1 a supercharger device 1 merely shown partially, which for example can be designed as exhaust gas turbocharger for a motor vehicle, comprises a guide vane device 2, with which a variable turbine and/or compressor geometry can be realised. Here, the guide vane device 2 comprises at least one vane mounting ring 3 with guide vanes 4 rotatably mounted thereon/therein and an adjusting ring 5 arranged coaxially to the vane mounting ring 3, via which the guide vanes 4 can be jointly adjusted. As can be seen from FIG. 1, the guide vanes 4 are rotatably mounted on the vane mounting ring 3 by means of vane pins 6, wherein the vane pins 6 axially penetrate the vane mounting ring 3 and are each connected in a rotationally fixed manner with the guide vane 4 on the one end and with a vane lever 7 on the other end, each of which carries a lever head 8 directed radially to the outside and thus engages in a corresponding clearance on the adjusting ring 5 which is not shown. A rotary movement of the adjusting ring 5 with respect to the vane mounting ring 3 thus brings about an even rotational movement of all guide vanes 4 about their vane pins 6.

DETAILED DESCRIPTION

In order to render mounting of the adjusting ring 5 rotatably designed with respect to the vane mounting ring 3 as simple as possible constructionally it is provided according to the invention that mounting of the adjusting ring 5 takes place on the vane mounting ring 3 via slide or roller bearings, each of which is arranged on a locating pin penetrating the vane mounting ring 3. The locating pin 9 simultaneously serves to define an axial spacing of the vane mounting ring 3 from a housing or from an insert piece/cover disc element 10 arranged therein. As is more preferably evident in FIG. 1 there is a radial gap between the locating pin 9 and the vane mounting ring 3, as a result of which an at least certain radial and axial displaceability of the vane mounting ring 3 with respect to the housing 10 is established. This displaceability makes it possible to better offset elongations and/or tolerances and reduces at least the danger of jamming the guide vanes 4.

According to FIG. 1, the roller bearing comprises a rotatably mounted bearing roller 11, which in axial direction is arranged adjacent to the vane mounting ring 3 on the one hand and to an axial stop 12, for example a nut, on the other end. The spacing between the vane mounting ring on the one end and the housing 10 on the other end is limited by two radial steps, namely a second radial step 13 and a third radial step 14 in the case of the embodiment according to FIG. 1. By way of the second radial step 13 the locating pin 9 supports itself on the insert piece/cover disc element 10, while it supports itself on the vane mounting ring 3 via the third radial step 14. Such radial steps 13, 14 can be produced in a particularly simple manner for example through a turning operation and thus do away with a spacer sleeve 15 to be provided in this region, as is proposed for example in FIGS. 5, 6, 8 and 9.

In order to be able to also fix the axial stop 12 with defined axial spacing from the vane mounting ring 3 an additional, namely a fourth radial step 16 can be provided, which in the assembled state is abutted by the axial stop 12. Here, the bearing roller 11 is mounted on the locating pin 9 in a smooth-running manner according to FIG. 1, wherein the axial spacing predetermined by the radial steps 14 and 16 between the axial stop 12 and the vane mounting ring 3 is greater than the axial longitudinal extension of the bearing roller 11, so that the latter can always be mounted without jamming. The same also applies to the guide vanes 4 since the axial spacing between the housing 10 and the vane mounting ring 3, which is limited by the second and third radial step 13, 14, reliably prevents jamming of the guide vanes 4 between the vane mounting ring 3 and the insert piece/cover disc element 10.

Figure 2:
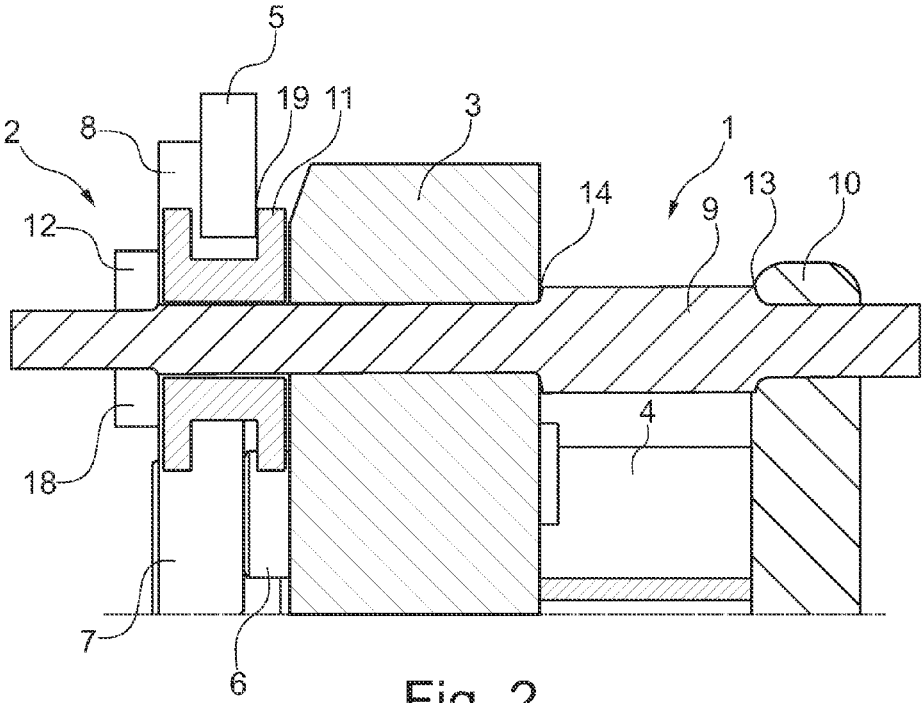
Figure 3:
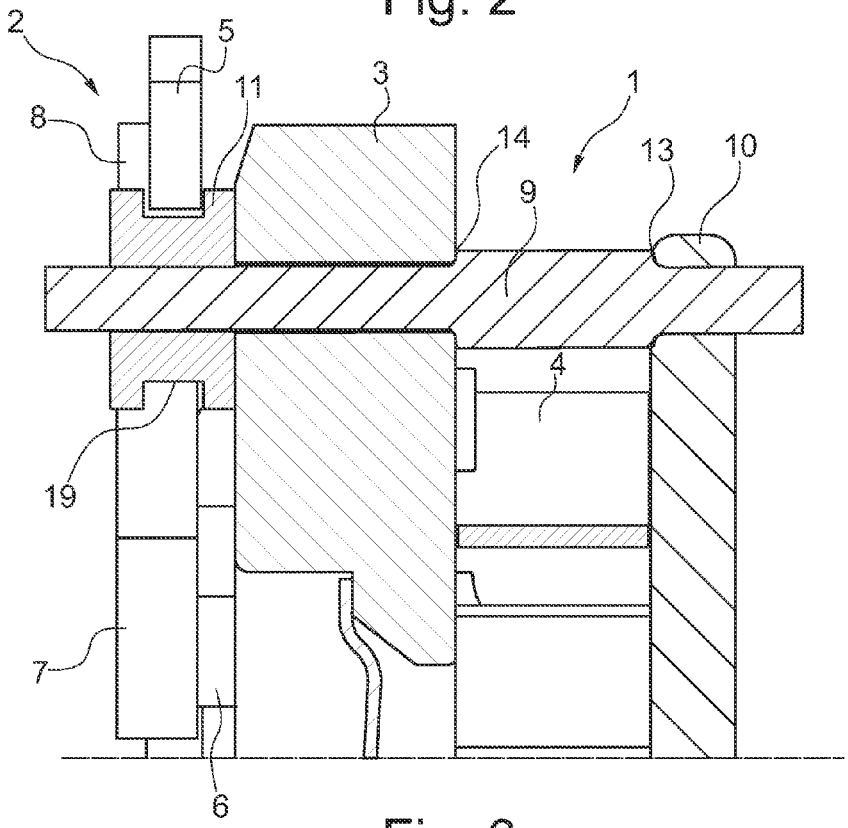
Figure 5:
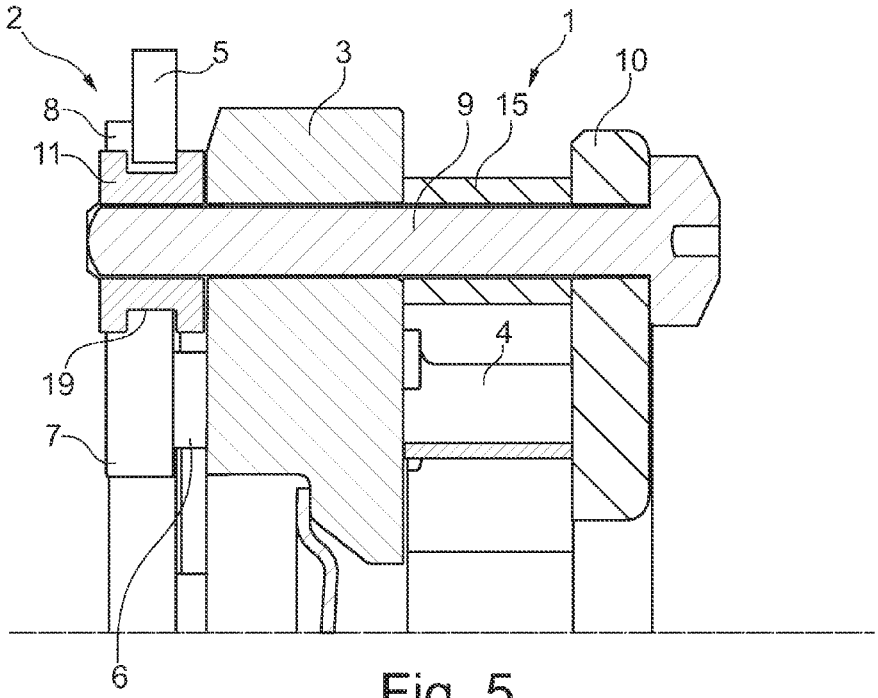
Figure 6:
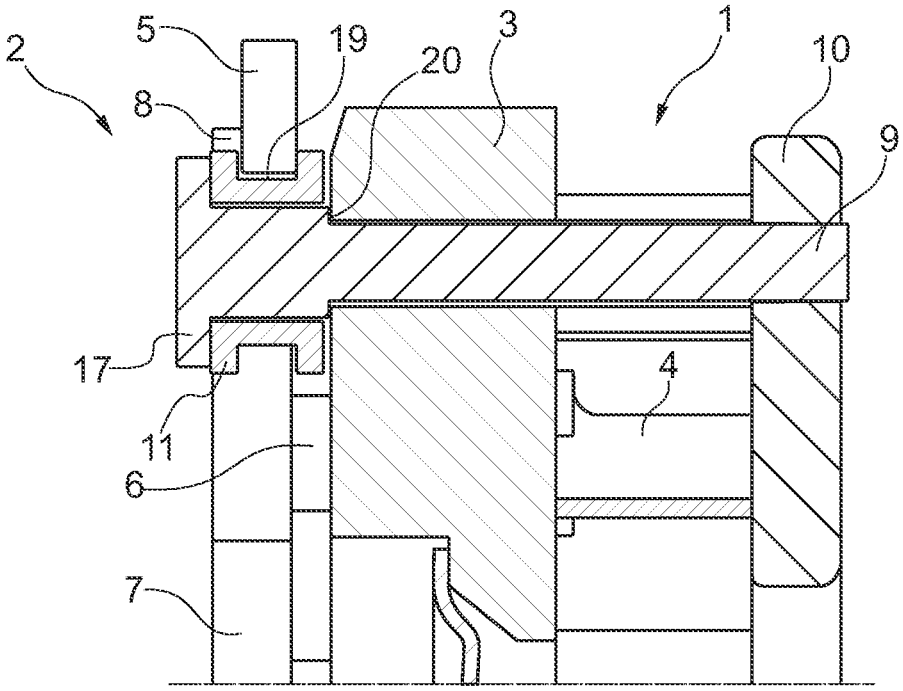
Figure 7:
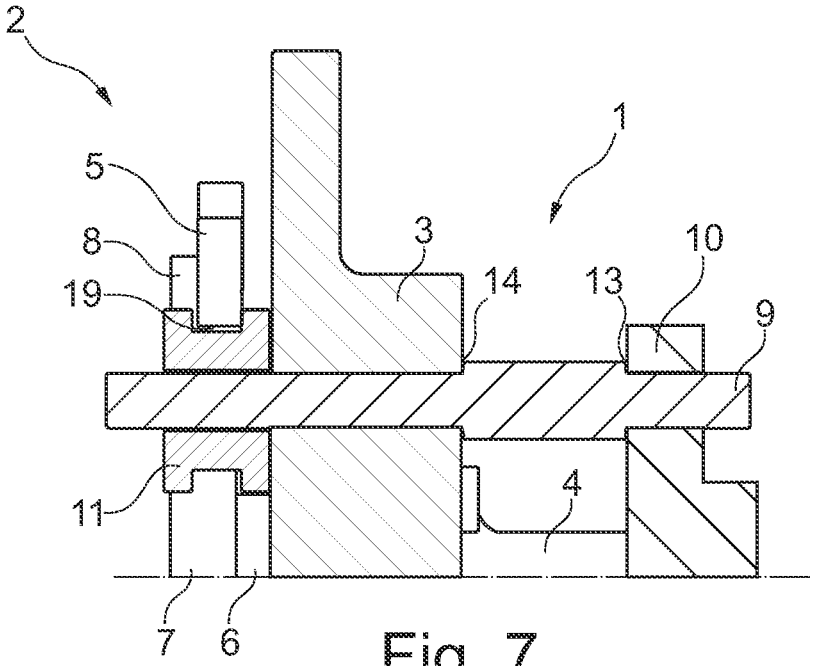
Figure 9:
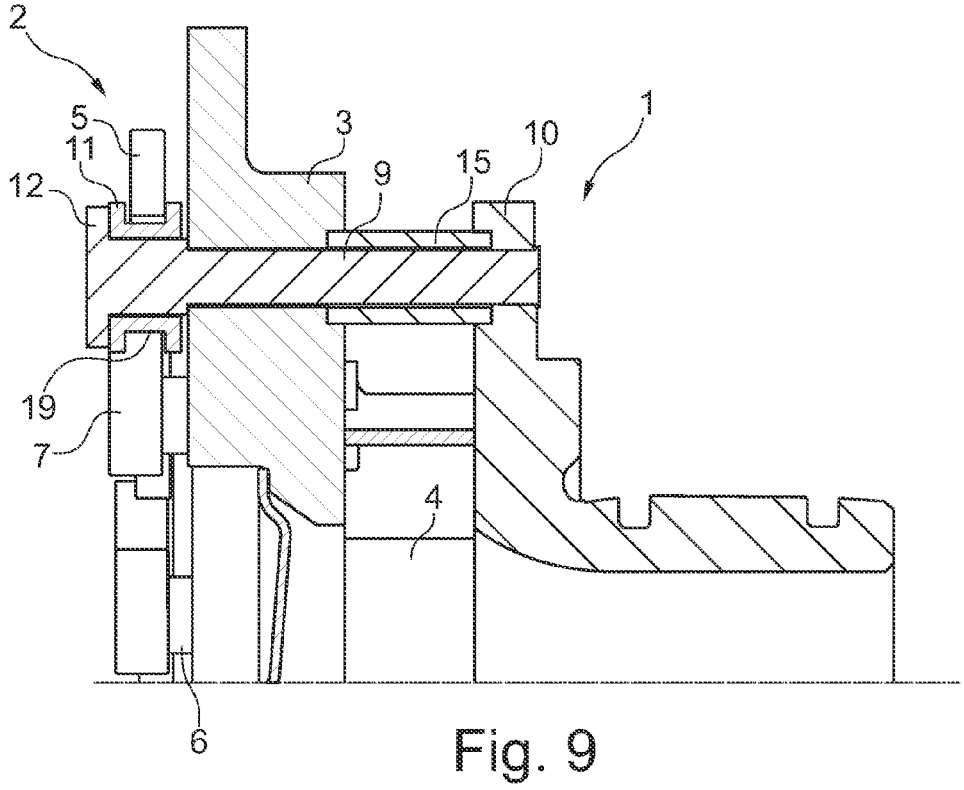

Instead of the axial stop 12 shown according to FIG. 1 the locating pin 9 at its end carrying the bearing roller 11 can also comprise a collar 17, as is shown for example in FIGS. 6 and 9. This collar 17 forms another embodiment for an axial stop 12. A further possibility for an axial stop 12 is formed by a bearing sleeve 18 comprising a collar, as is shown for example in accordance with FIG. 2. Here, the bearing sleeve 18 is arranged between the locating pin 9 and the associated roller bearing, i.e. the bearing roller 11, wherein the bearing sleeve 18 has a greater axial extension than the bearing roller 11, so that the latter is arranged with play between the vane mounting ring 3 and the collar of the bearing sleeve 18. Here, the bearing rollers 11 shown in accordance with FIGS. 1 to 7 and 9 can also be designed as slide bearings, so that these are not rotatably mounted with respect to the locating pin 9, but the adjusting ring 5 is mounted, more preferably guided in a circumferential groove 19 of the bearing roller 11 designed as slide bearing.

Figure 4:
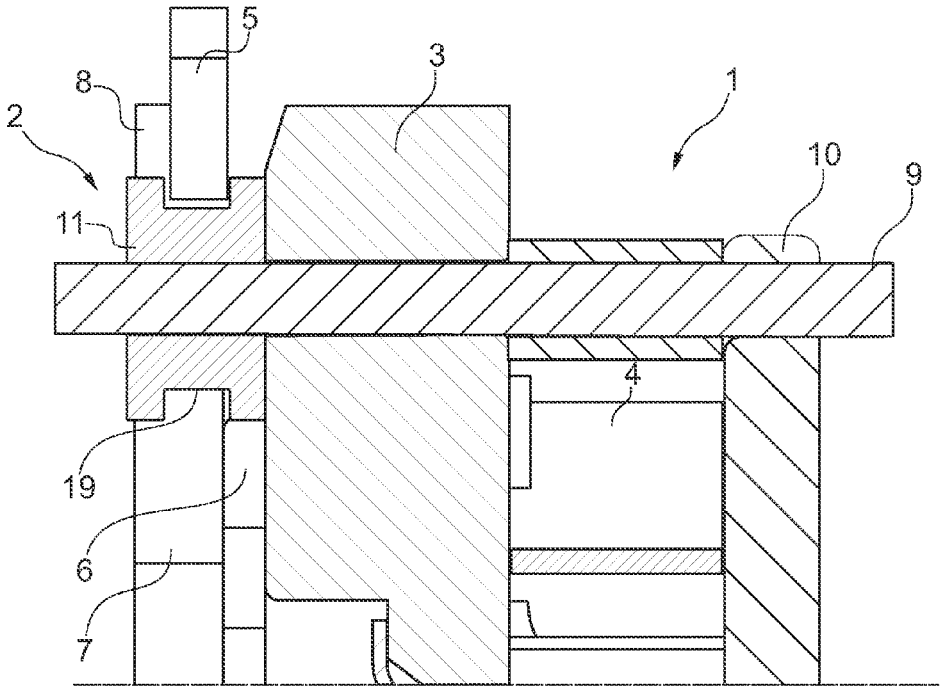

According to FIGS. 4 and 5 the locating pin 9 is designed without radial steps, which is why in this case, for the reliable definition of the axial spacing between the vane mounting ring 3 on the one end and the insert piece/cover disc element 10 on the other end, the locating pin 9 is permanently joined, more preferably pressed together both with the insert piece/cover disc element 10 as well as with the vane mounting ring 3. The bearing roller 11 can also be designed as slide bearing with these embodiments.

Considering the embodiment according to FIG. 6, it is evident that the locating pin 9 comprises a first radial step 20 via which it supports itself on the vane mounting ring 3 and wherein an axial spacing between the first radial step 20 and the collar 17 of the locating pin 9 is greater than the axial extension of the bearing roller 11, so that the latter can be arranged with play between the vane mounting ring 3 and the collar 17 of the locating pin 9. Mounting of the bearing roller 11 free of jamming is also established in this case.

Figure 8:
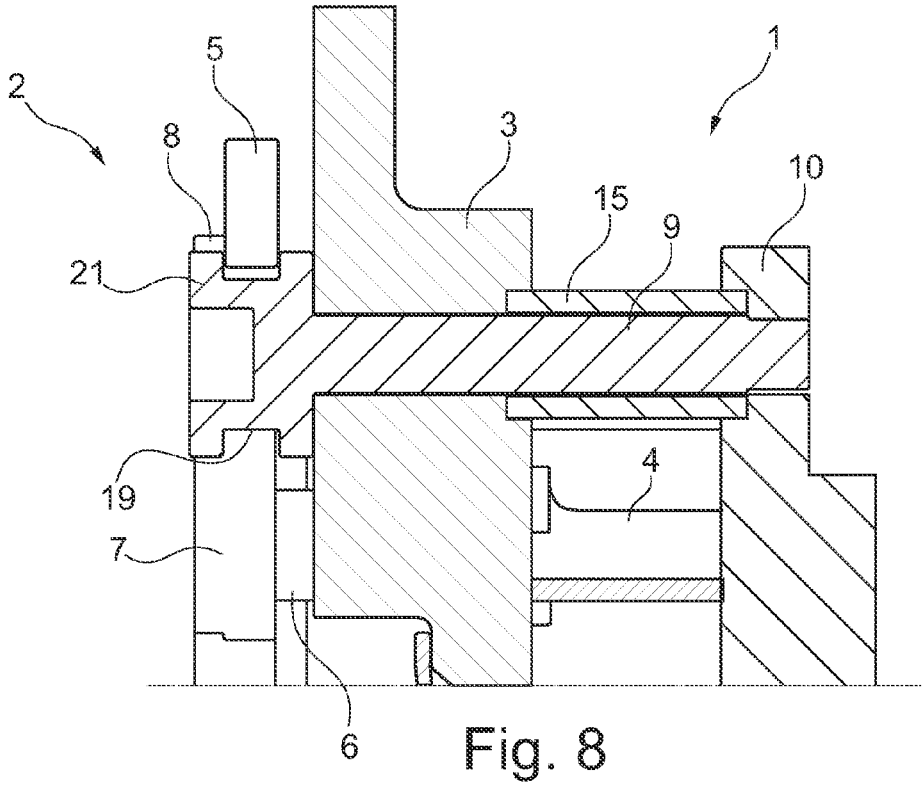

In contrast with FIG. 6, wherein the spacer sleeve 15 lies on the insert piece/cover disc element 10 on the face end or the vane mounting ring 3, the spacer sleeves 15 according to FIGS. 8 and 9 are each inserted in the vane mounting ring 3 on the one end and in the housing 10 on the other end. Because of this it is possible to thermally decouple the locating pin 9 from the hot exhaust gases flowing about the guide vanes 4, as a result of which the locating pin 9 is altogether arranged in a protected manner.

Preferentially, fastening of the locating pin 9 to the insert piece/cover disc element 10 or on the housing is provided by means of rivets, screws or welding with all supercharger devices 1 shown. FIGS. 1-4 and 7 show the locating pin 9 for example in the non-riveted state. In FIGS. 5 and 8 and 9 the locating pin 9 can also be screwed into the insert piece/cover disc element 10.

According to FIG. 8, a bearing head 21 with a circumferential groove 19 is provided on an end of the locating pin 9 facing the adjusting ring 5, in which the adjusting ring 5 is guided in a sliding manner. Reliable mounting of the adjusting ring 5 on the vane mounting ring 3 generally requires that at least three bearing rollers 11 or three bearing heads 21 with an angular region of 120° each are provided between two bearing rollers 11/bearing heads 21. Obviously it is also conceivable that four or more bearing rollers 11 are provided.

Through the supercharger device according to the invention particularly simple and highly functional mounting of the adjusting ring 5 on the vane mounting ring 3 can be realised, since the locating pins 9, which define an axial spacing between the vane mounting ring 3 and the insert piece/cover disc element 10, simultaneously function as carriers for the bearing rollers 11 or bearing heads 21 supporting the adjusting ring 5. Because of this a reduction of the parts variety is additionally achieved, as a result of which storage and logistics costs can also be reduced.

The invention claimed is:

1. A supercharger device, comprising:

at least one of a variable turbine and a compressor geometry;

a guide vane device arranged in a housing, wherein the guide vane device includes at least one vane mounting ring;

at least one guide vane is at least one of rotatably mounted thereon the vane mounting ring and rotatably mounted therein the vane mounting ring; and an adjusting ring arranged coaxially to the vane mounting ring and mounted on the latter, which is rotated relative to the vane mounting ring such that the guide vanes are adjustable, wherein the mounting of the adjusting ring on the vane mounting ring is effected via at least one of a slide and roller bearings, each of which is arranged on at least one locating pin penetrating the vane mounting ring, wherein the at least one locating pin defines an axial spacing of the vane mounting ring from at least one of the housing, an insert piece and a cover disc element arranged therein, and wherein at least one end of at least one locating pin carries the roller bearing, the roller bearing including a collar which forms an axial stop for at least one of the roller bearing and the bearing roller, and wherein the collar is at least one of arranged coaxially around the locating pin and formed as part of the locating pin.

2. The supercharger device according to claim 1, wherein the roller bearing includes a rotatably mounted bearing roller that is provided on each locating pin.

3. The supercharger device according to claim 1, wherein at least one locating pin includes a first radial step, via which said locating pin supports itself on the vane mounting ring and wherein an axial spacing between the first radial step and the collar of the locating pin is greater than an axial extension of the bearing roller, so that the latter is arranged with clearance between the vane mounting ring and the collar of the locating pin.

4. The supercharger device according to claim 3, wherein at least one locating pin in addition to the first radial step includes a second radial step, via which the locating pin supports itself on at least one of the housing, an insert piece and a cover disc element arranged therein, and wherein between the vane mounting ring and at least one of the housing, insert piece and cover disc element a spacer sleeve is provided surrounding the locating pin.

5. The supercharger device according to claim 4 wherein the spacer sleeve is worked into at least one of the vane mounting ring, the insert piece and the cover disc element.

6. The supercharger device according to claim 3, wherein the locating pin includes a second radial step and a third radial step axially adjacent thereto, wherein the locating pin supports itself via the second radial step on at least one of the housing, the insert piece and the cover disc element arranged therein and via the third radial step on the vane mounting ring.

7. The supercharger device according to claim 1, wherein on an end of the locating pin facing the adjusting ring a bearing head is provided with a circumferential groove, wherein the adjusting ring is guided in a sliding manner.

8. The supercharger device according to claim 1, wherein at least one of three bearing rollers and three bearing heads, each with an angular region of approximately 120° located between at least one of two bearing rollers and two bearing heads are provided.

9. A combustion engine, comprising:

a supercharger device including, at least one of a variable turbine and a compressor geometry; a guide vane device arranged in a housing, wherein the guide vane device includes at least one vane mounting ring; at least one guide vane is at least one of rotatably mounted thereon the vane mounting ring and rotatably mounted therein the vane mounting ring; and an adjusting ring arranged coaxially to the vane mounting ring and mounted on the latter, which is rotated relative to the vane mounting ring such that the guide vanes are adjustable, wherein the mounting of the adjusting ring on the vane mounting ring is effected via at least one of a slide and roller bearings, each of which is arranged on at least one locating pin penetrating the vane mounting ring, and wherein the at least one locating pin defines an axial spacing of the vane mounting ring from at least one of the housing, an insert piece and a cover disc element arranged therein, and wherein at least one end of at least one locating pin carries the roller bearing, the roller bearing including a collar which forms an axial stop for at least one of the roller bearing and the bearing roller, and wherein the collar is at least one of arranged coaxially around the locating pin and formed as part of the locating pin.

10. The combustion engine according to claim 9, further comprising: a bearing sleeve having a collar, which is arranged between the locating pin and the associated roller bearing, and wherein the bearing sleeve has a greater axial extension than the roller bearing, so that it is arranged with clearance between the vane mounting ring and the collar of the bearing sleeve.

11. The combustion engine according to claim 9, wherein the roller bearing includes a rotatably mounted bearing roller that is provided on each locating pin.

12. The combustion engine according to claim 9, wherein at least one locating pin includes a first radial step, via which said locating pin supports itself on the vane mounting ring, and wherein an axial spacing between the first radial step and the collar of the locating pin is greater than an axial extension of the bearing roller, so that the latter is arranged with clearance between the vane mounting ring and the collar of the locating pin.

13. The combustion engine according to claim 12, wherein at least one locating pin in addition to the first radial step includes a second radial step, via which the locating supports itself on at least one of the housing, an insert piece and cover disc element arranged therein, wherein between the vane mounting ring and at least one of the housing, insert piece and cover disc element a spacer sleeve is provided surrounding the locating pin.

14. The combustion engine according to claim 12, wherein the locating pin includes a second radial step and a third radial step axially adjacent thereto, wherein the locating pin supports itself via the second radial step on at least one of the housing, the insert piece and cover disc element arranged therein and via the third radial step on the vane mounting ring.

15. The combustion engine according to claim 13, wherein the spacer sleeve is worked into at least one of the vane mounting ring, the insert piece and cover disc element.

16. The combustion engine according to claim 9, wherein on an end of a locating pin facing the adjusting ring a bearing head is provided with a circumferential groove, wherein the adjusting ring is guided in a sliding manner.

17. The combustion engine according to claim 9, wherein at least one of three bearing rollers and three bearing heads, each with an angular region of approximately 120° located between at least one of two bearing rollers and two bearing heads are provided.

18. A supercharging device, comprising:

at least one of a variable turbine and a compressor geometry;

a guide vane device arranged in a housing, wherein the guide vane device includes at least one vane mounting ring;

at least one guide vane is at least one of rotatably mounted thereon the vane mounting ring and rotatably mounted therein the vane mounting ring;

an adjusting ring arranged coaxially to the vane mounting ring and mounted on the latter, which is rotated relative to the vane mounting ring such that the guide vanes are adjustable, wherein the mounting of the adjusting ring on the vane mounting ring is effected via at least one of a slide and roller bearings, each of which is arranged on at least one locating pin penetrating the vane mounting ring, wherein the at least one locating pin defines an axial spacing of the vane mounting ring from at least one of the housing, an insert piece and a cover disc element arranged therein; and a bearing sleeve having a collar, which is arranged between the locating pin and the associated roller bearing, and wherein the bearing sleeve has a greater axial extension than the roller bearing, so that it is arranged with clearance between the vane mounting ring and the collar of the bearing sleeve.

* * * * *